United States Patent [19]

Goott

[11] 4,441,714

[45] * Apr. 10, 1984

[54] POKER-TYPE TABLE GAME

[75] Inventor: Joseph Goott, Great Falls, Mont.

[73] Assignee: Tropic Industries, Inc., Salt Lake City, Utah

[ * ] Notice: The portion of the term of this patent subsequent to Dec. 21, 1999 has been disclaimed.

[21] Appl. No.: 198,175

[22] Filed: Oct. 17, 1980

Related U.S. Application Data

[63] Continuation-in-part of Ser. No. 43,678, May 30, 1979, Pat. No. 4,364,567.

[51] Int. Cl.[3] ..... A63F 1/00

[52] U.S. Cl. ..... 273/144 B; 273/138 A; 273/274

[58] Field of Search ..... 273/138 R, 138 A, 139, 273/144 R, 144 A, 148 R, 149 R, 149 P, 274, 309; D21/25, 26

[56] References Cited

U.S. PATENT DOCUMENTS

| | | | |
|---|---|---|---|
| 1,723,377 | 8/1929 | Salomon | 273/274 X |
| 2,383,860 | 8/1945 | Hickey | 273/148 R |
| 3,300,217 | 1/1967 | Franklin | 273/144 A X |
| 3,810,627 | 5/1974 | Levy | 273/138 A |
| 3,998,462 | 12/1976 | Goott | 273/138 R |

FOREIGN PATENT DOCUMENTS

| | | | |
|---|---|---|---|
| 1348632 | 3/1974 | United Kingdom | 273/274 |

OTHER PUBLICATIONS

Scarne's Complete Guide to Gambling, by John Scarne, Simon and Schuster, N.Y., 1961, Race-Horse Keno, pp. 432–436.

*Primary Examiner*—Robert A. Hafer
*Assistant Examiner*—Arnold W. Kramer
*Attorney, Agent, or Firm*—Antonelli, Terry & Wands

[57] ABSTRACT

A poker-type table game which can be played by one or more persons. The game comprises a Keno-like enclosed bowl containing fifty-two balls each bearing the representation of a card in a conventional deck of playing cards. After the balls are mixed or shuffled in the bowl to assure randomness, a number of balls, corresponding to the number of cards dealt in a poker hand (e.g. six cards), are blown into a "unicorn" at the top of the bowl in consecutive order. The results of the hand are displayed on a game table. Prior to the initiation of the game, i.e. blowing the balls into the "unicorn", each player uses chips or the like, in attempting to guess, for example, if one or more of the cards has a value or "9" or better with Aces being high, or a value of "2" through "7" being low. Each player can also use the chips to guess if the hand contains conventional combinations such as a straight, a flush, three of a kind or the like and also if any cards in the hand are among three cards of a particular suit and/or are a card of a particular value but of any suit.

12 Claims, 2 Drawing Figures

POKER-TYPE TABLE GAME

This application is a continuation-in-part of my application Ser. No. 43,678, filed May 30, 1979 and now U.S. Pat. No. 4,364,567 and incorporates by reference herein the disclosure of that application.

The present invention is directed to a game using a novel combination of a Keno-type game and a modified form of the game described in my U.S. Pat. No. 3,998,462, issued Dec. 21, 1976, which is played basically upon probabilities and, more particularly, a game of chance which utilizes elements of Keno, poker, and roulette and which can be played by several players or even only one player.

The game of the present invention is particularly enjoyable and readily understood by those who are only vaguely or not at all familiar with games of chance. Even those who are not familiar with poker or Keno are able to play the game of the present invention intelligently because the rules are relatively simple and the odds of guessing successfully are printed on the game board. Moreover, players can make inconsistent plays and/or can "split" their guesses, if they so desire, by virtue of the arrangement of the game surface and the manner in which the game is played.

The foregoing objects have been achieved in accordance with the present invention by providing a Keno-type apparatus and a game table. With the present invention, 52 balls are present in an enclosed bowl and each bears a representation of one of 52 cards in a conventional playing deck of cards used in poker. That is, each ball contains the representation of a suit (e.g. Heart) as well as the value of a card (e.g. 2, 3, 4, etc. or Jack, Queen or King). At the beginning of a game, the operator blows at random six balls from the bowl, wherein the fifty-two balls have been mixed or shuffled, into a "unicorn" in the order 1 through 6 to represent a dealer who normally places the dealt cards face down from a deck of cards in dealing a hand. According to the present invention, prior to the six balls representing cards of a hand being blown into the "unicorn", each player can guess with chips or the like being placed in designated areas on the game table whether each card is a high (Hi) card (e.g. 9, 10, Jack, Queen, King, Ace) or a low (Lo) card (e.g. 2, 3, 4, 5, 6, or 7). If, for example, six balls are blown into the "unicorn", each player will have the opportunity of guessing whether one or more of the "cards" is a high card or a low card. Of course, the players are not required to make any such guess, although it is obviously expected that each participant will play some aspect of the game during each "hand" that is dealt by the operator.

Furthermore, prior to the six balls being blown into the "unicorn" to represent the number of cards in a hand, each player can guess if five of the "cards" in that six-card hand are all red, all black, all Hi cards or all Lo cards. Furthermore, the players can guess if the "hand" will contain an "8" of a particular suit or if any four cards in the six-card "hand" will consist of the cards of one suit, based upon odds which are printed on the game board, whether the dealt hand will constitute two pair, three of a kind, a straight, and/or a flush. In addition, the players can guess if any of the balls dealt in the hand will be a "2", "3", or "4" of a particular suit, or a "5", "6", or "7" of a particular suit, or a "9", "10", or Jack of a particular suit, or a Queen, King, or Ace of a particular suit. At the same time, the players can attempt to guess which card values (i.e., Ace, 2, 3, . . . King), irrespective of suit, will be dealt in a particular hand. The players can also "split" their guesses on certain combinations of the hand as explained more fully hereinbelow.

BRIEF DESCRIPTION OF THE DRAWING

These and further objects and features of the present invention will become more apparent from the following description when taken in conjunction with the following drawing which shows, for purposes of illustration only, a preferred embodiment of the present invention, and more particularly.

DETAILED DESCRIPTION OF THE PREFERRED EMBODIMENT

Figure 1:
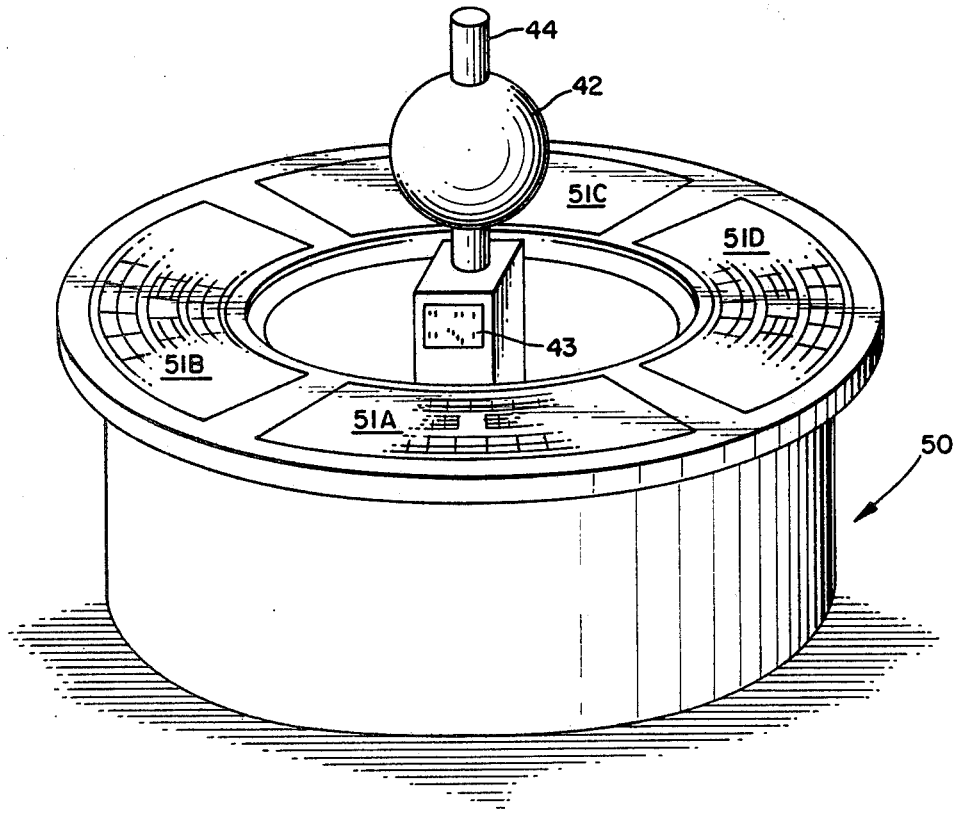
FIG. 1 shows an embodiment of the game table using the novel arrangement on board surfaces upon which the game results are electrically displayed.
Figure 2:
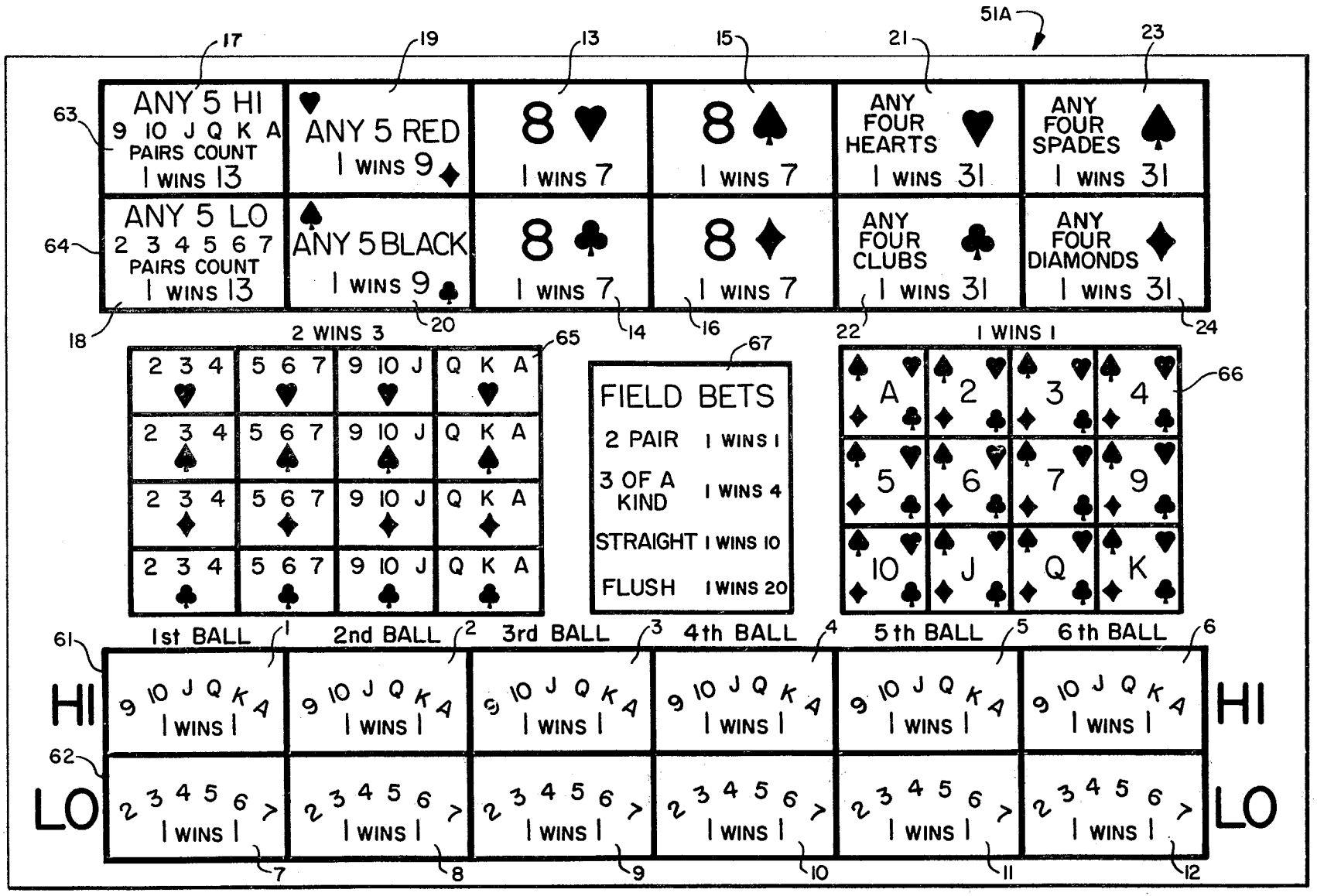
FIG. 2 is a plan view of one of the board surfaces on the game table shown in FIG. 1.

The embodiment shown in FIGS. 1 and 2 uses an enclosed globe or bowl 42 which can be located on or near a game table designated generally by the numeral 50 having one or more game surfaces thereon. The bowl contains fifty-two balls representing the thirteen cards of each suit (Hearts, Diamonds, Spades, and Clubs) in a conventional playing deck. In the embodiment shown in FIG. 1, the game table 50 has four identical surfaces 51A, 51B, 51C, and 51D, upon each of which the results of a particular hand are displayed. However, it can have a greater or lesser number of such surfaces. Players can thus play upon any of the available surfaces such as the one shown in FIG. 2, and make their guesses by placing chips or the like in the particular area on the table surface in which the player is attempting to guess whether the card or cards selected in a particular hand will have a certain value or will have a certain combination of values or will be of a certain suit or the like. A control panel 43 (shown schematically) permits the dealer or operator before the beginning of the game to randomly mix or shuffle the balls in the bowl. The dealer then blows six balls into the "uniform" 44 and then presses the appropriate display buttons on the control panel 43, via conventional electronic means, to display the results, including combinations, upon each of the surfaces 51A, 51B, 51C, and 51D so that any winning guesses can be quickly ascertained.

The surface 51A shown in FIG. 2, as well as the other surfaces, are provided with two rows of six aligned boxes 61 and 62. One row 61 of boxes (the boxes of which are designated only for descriptive purposes here by the numerals 1 through 6) is adjacent the word "HI." Similarly, the other row 62 of boxes (the boxes of which are designated only for description purposes here by numerals 7 through 12) is aligned with the "HI" boxes and is adjacent the word "Lo". The manner and sequence in which the players utilize these boxes will be described hereinbelow. However, it can be seen that the players have a choice for each card being dealt of guessing whether such card is a (Hi) card of any suit (i.e., 9, 10, Jack, Queen, King, or Ace), or a low (Lo) card of any suit (i.e., 2, 3, 4, 5, 6, or 7). In any event, the odds given for correctly guessing whether such card is "HI" or "Lo" can also be stated in each of the boxes 1 through 6 and 7 through 12 as being 1 for 1. If, for example, on the first ball blown the card value is "4" then box 7 will be lighted; likewise, if on the fifth ball blown the card value is a "King" then box 5 will be lighted. Either the Hi or Lo box corresponding to each ball blown during a "hand" is lighted except where the card value is an "8".

Two rows 63, 64 of boxes (each of which is designated only for purposes of description here by the numerals 13 through 24) are also provided on the game board surface 51A where the players can guess in boxes 19 and 20 the chance of at least five of the cards dealt in a hand being in red suits or in black suits and/or in boxes 17 and 18 of all high cards (9, 10, Jack, Queen, King, Ace with pairs counting as separate cards) or all low cards (2 through 7, with pairs counting as separate cards); in boxes 21 through 24 that at least four of the cards will be of a particular suit; and in boxes 13 through 16 that the hand will contain an "8" of a particular suit. Again, the odds on the correctness of any such guess can be stated in each of the appropriate boxes and may vary substantially according to the mathematical probability of successfully achieving such a combination of value. There is also provided in a group of boxes designated generally by the numeral 65, a space for each player to guess if any of the cards in a particular hand dealt will contain cards with a value of "2", "3", or "4" in a particular suit, and/or a value of "5", "6", or "7" in a particular suit, and/or a value of "9", "10", or Jack in a particular suit, and/or a value of Queen, King, or Ace in a particular suit. A player can be successful if any of the six balls randomly selected yields the appropriate value and suit which the player guessed. If, for example, any of the cards in the hand is a "2", "3", or "4" of diamonds the appropriate box in the group of boxes 65 will light up. Any players having chips on the particular box will win according to the printed odds. Likewise, there is provided a further group of boxes designated generally by the numeral 66 with a space for each player to guess what the individual values of cards will be in a hand (e.g. 2, 7, or Ace), irrespective of the suit. Certain of the boxes can also allow for split play, i.e. placing a chip or chips so as to bridge boxes to increase the chances of a winning guess. For example, the boxes 13 through 16 of "8" of different suits and the boxes 21 through 24 of four cards of the same suit can be used for split play.

Arranged approximately in the center or at some other convenient portion of the game board surface 51A is a box 67 larger than the above-described boxes. In this box are contained "field bets" for two pair, three of a kind, a straight, and a flush.

Players can play upon any of the surfaces, 51A, 51B, 51C, or 51D, and make their guesses before the dealer blows the balls in the "unicorn" 44 by placing chips or the like in a particular area on the table surface in which the player is attempting to guess whether the card or cards in a particular hand selected by operation of the balls in the bowl will have a certain value or will have a certain combination of values or will be of a certain suit or the like. The dealer blows the balls into the "unicorn" and then presses the appropriate display buttons on the panel 43, via conventional electronic means, to display the results, including combinations, upon the surfaces 51A, etc. so that winning guesses can be quickly ascertained.

While I have shown and described an embodiment of my invention, it is to be clearly understood that the same is susceptible of changes and modifications without departing from the scope of the invention. Therefore, I do not wish to be limited to the details shown and described herein but intend to cover all such modifications as are encompassed by the scope of the appended claims.

I claim:

1. A game playable by at least one person, comprising a game board having means associated with the surface thereof for designating a plurality of positions corresponding to combinations and values as occur in a card game; and means associated with said at least one game board for selecting a number of balls corresponding to the number of cards dealt in a card game hand from a group of balls representing each of the cards in a deck of playing cards and displaying the results of the balls selected at one or more of the positions on the surface of said at least one game board, said position-designating means including a first series of defined areas actuatable to notify each player guessing with respect thereto if the selected ball associated with that area has a value of "9", "10", Jack, Queen, King, or Ace and a second series of defined, areas in line with said first series and selectively actuatable to notify each player guessing with respect thereto if the selected ball associated with that area has a value of "2", "3", "4", "5", "6", or "7".

2. A game as set forth in claim 1, wherein the first series is designated as the "HI" series of defined areas and the second series is defined as the "LO" series of defined areas.

3. A game as set forth in claim 1, wherein the position-designating means has associated therewith the odds against which each player is guessing for a particular combination of selected balls and/or a particular value or suit of a selected ball.

4. A game as set forth in claim 1, wherein the position-designating means includes a third series of defined areas selectively actuatable to notify each player guessing with respect thereto if any selected ball is an "8" of any suit and/or if at least four selected balls are of the same suit and/or if at least five selected balls are of suits of red or black and/or if at least five balls have a value of "9", "10", Jack, Queen, King, or Ace, with pairs of those values counting as two separate cards or a value of "2", "3", "4", "5", "6", or "7", with pairs of those values counting as two separate cards.

5. A game as set forth in claim 1, wherein the position-designating means includes a third series of defined areas selectively actuatable to notify each player guessing with respect thereto if any selected ball has a value of "2", "3", or "4" of any suit and/or of any selected ball has a value of "5", "6", or "7" of any suit and/or if any selected ball has a value of "9", "10" or Jack of any suit and/or of any selected ball has a value of Queen, King or Ace of any suit.

6. A game as set forth in claim 5, wherein the position-designating means includes a third series of defined areas corresponding to a card of each value of any suit in a deck of playing cards and selectively actuatable to notify each player guessing with respect thereto the values of the selected balls.

7. A game as set forth in claim 1, wherein the position-designating means includes a third series of defined areas and selectively actuatable to notify each player guessing with respect thereto if the selected balls includes two pair and/or three of a kind and/or a straight and/or a flush.

8. A game as set forth in claim 7, wherein the position-designating means includes a fourth series of defined areas selectively actuatable to notify each player guessing with respect thereto if any selected ball is an "8" of any suit and/or if at least four selected balls are of the same suit and/or if at least five selected balls are of suits of red or black and/or if at least five balls have a value of "9", "10", Jack, Queen, King, or Ace, with pairs of those values counting as two separate cards or a value of "2", "3", "4", "5", "6", or "7", with pairs of those values counting as two separate cards.

9. A game as set forth in claim 8, wherein the position-designating means includes a fifth series of defined areas selectively actuatable to notify each player guessing with respect thereto if any selected ball has a value of "2", "3", or "4" of any suit and/or if any selected ball has a value of "5", "6", or "7" of any suit and/or if any selected ball has a value of "9", "10", or Jack of any suit and/or if any selected ball has a value of Queen, King or Ace of any suit.

10. A game as set forth in claim 9, wherein the position-designating means includes a sixth series of defined areas corresponding to a card of each value of any suit in a deck of playing cards and selectively actuatable to notify each player guessing with respect thereto the values of the selected balls.

11. A game as set forth in claim 10, wherein the first series is designated as the "HI" series of defined areas and the second series is defined as the "LO" series of defined areas.

12. A game as set forth in claim 11, wherein the position-designating means has associated therewith the odds against which each player is guessing for a particular combination of selected balls and/or a particular value or suit of a selected ball.

* * * * *